United States Patent [19]

Sare et al.

[11] Patent Number: 4,953,612

[45] Date of Patent: Sep. 4, 1990

[54] COMPOSITE METAL ARTICLES

[75] Inventors: Ian R. Sare, Coromandel Valley; Ian Henderson, Glen Osmond; Teunis Heijkoop, Highbury; Michael R. Bosworth, Walkerville; Ronald E. Aspin, Henley Beach; Brian K. Arnold, Panorama, all of Australia

[73] Assignees: Commonwealth Scientific & Industrial Research Organization; Vida-Weld Pty. Limited, both of Australia

[21] Appl. No.: 361,753

[22] Filed: Jun. 2, 1989

Related U.S. Application Data

[63] Continuation of Ser. No. 266,301, Oct. 31, 1988, abandoned, which is a continuation of Ser. No. 914,817, Oct. 3, 1986, abandoned, which is a division of 714,557, filed as PCT AU84/00123 on Jun. 29, 1984, published as WO85/00308 on Jan. 31, 1985, Pat. No. 4,635,701.

[30] Foreign Application Priority Data

| | | | |
|---|---|---|---|
| Jul. 5, 1983 | [AU] | Australia | PG0130 |
| Nov. 22, 1983 | [AU] | Australia | PG2499 |
| Nov. 22, 1983 | [AU] | Australia | PG2500 |

[51] Int. Cl.[5] ..... B22D 19/08

[52] U.S. Cl. ..... 164/102; 164/103

[58] Field of Search ..... 164/102, 103, 98, 99

[56] References Cited

U.S. PATENT DOCUMENTS

| | | | |
|---|---|---|---|
| 39,531 | 8/1863 | Savary . | |
| 2,235,199 | 11/1938 | Chace . | |
| 2,881,491 | 4/1959 | Jominy et al. . | |
| 3,279,006 | 10/1966 | Schwartz et al. . | |
| 3,342,564 | 9/1967 | Schwartz et al. . | |
| 4,121,335 | 10/1978 | Berman et al. | 164/984 |

FOREIGN PATENT DOCUMENTS

| | | | |
|---|---|---|---|
| 1290306 | 3/1969 | Fed. Rep. of Germany . | |
| 56-89368 | 7/1981 | Japan | 164/99 |
| 58-38654 | 3/1983 | Japan | 164/98 |
| 558754 | 7/1977 | U.S.S.R. . | |
| 745592 | 7/1980 | U.S.S.R. . | |
| 980952 | 12/1982 | U.S.S.R. . | |
| 888404 | 1/1962 | United Kingdom . | |
| 928928 | 6/1963 | United Kingdom . | |
| 977207 | 12/1964 | United Kingdom . | |
| 1053913 | 1/1967 | United Kingdom . | |
| 1152370 | 5/1969 | United Kingdom . | |
| 1247197 | 9/1971 | United Kingdom . | |
| 2044646 | 10/1980 | United Kingdom . | |

OTHER PUBLICATIONS

English translation of SU 558-754.
English translation of JAP 56-89368.
English translation of JAP 136823.
Copy of International Search Report (International Application No. PCT/AU 84/00123.

*Primary Examiner*—Kuang Y. Lin
*Attorney, Agent, or Firm*—Merchant, Gould, Smith, Edell, Welter & Schmidt

[57] ABSTRACT

A composite article having a first and a second metal component, and a resultant composite metal article, wherein a flux coating is applied over at least a substantially oxide-free bond surface of the first component, the first component with the flux coating is preheated and, with the first component positioned in a mold to fill a portion of a cavity of the mold, a melt for providing the second component is poured into the mold so as to flow over the bond surface; the first component being preheated to a first temperature and the melt being poured at a second temperature such that, on flowing over the bond surface, the melt displaces the flux coating and wets the bond surface, and that such initial temperature equilibration between the surface and the melt results in an interface temperature therebetween at least equal to the liquidus temperature of the melt, thereby resulting on solidification of the melt in attainment of a bond between the components.

10 Claims, 2 Drawing Sheets

COMPOSITE METAL ARTICLES

This is a continuation of application Ser. No. 266,301, filed Oct. 31, 1988, which is a continuation of application Ser. No. 914,817, filed Oct. 3, 1986, both now abandoned, which is a division of application Ser. No. 714,557, filed as PCT AU84/00123 on Jun. 29, 1984, published as WO85/00308 on Jan. 31, 1985, now U.S. Pat. No. 4,635,701.

The invention relates to composite metal articles. The invention particularly relates to articles of two different metal securely bonded together, with one metal protecting the other in a manner required for a particular application.

A wide variety of procedures has been proposed for providing composite metal articles to enable use of desirable properties of two dissimilar metals. Thus, articles of a metal of low corrosion resistance frequently are protected by hard-facing or cladding with a wear or corrosion resistant metal such as stainless steel. Alternatively, tough but readily machinable metals can be similarly protected by application of a material which provides in a composite article the required wear resistance. In the latter case, the tough metal supports and retains a relatively brittle abrasion resistant material which may fracture under impact loading, while also enabling machining and fixing of the composite article in a manner possible only with difficulty for an article of abrasion resistant material alone.

Hardfacing by weld deposition of metal to provide a composite article, while widely used, is relatively slow, labour intensive, relatively costly and subject to a number of practical limitations. However, recourse to hardfacing is necessary in many applications because of the lack of an economic and/or practical alternative. A variety of alternative proposals is set out in U.K. patent specification Nos. 888404, 928928, 977207, 1053913, 1152370, 1247197 and 2044646 and in U.S. Pat. Nos. 3279006 and 3342564.

U.K. No. 888404 proposes a process for clad steel products, such as of mold or low alloy steel and a stainless steel, clad by casting a melt of one of the steels around a solid of the other steel. The solid other metal is mechanically or chemically cleaned prior to the casting process, while casting is performed under a substantial vacuum. However, it is made clear that no complete bond is made merely by the casting process. The composite article thus has to be hot-rolled to weld the two steels together; the bonding being effected by the hot rolling. The process thus suffers from the disadvantages of having to be performed under vacuum, a procedure not well suited to many production situations; while the need for hot rolling limits the choice of materials with which the process can be applied, as well as the form of the resultant composite article.

U.K. No. 928928 is concerned with liners for grinding mills, and points out the problems resulting from making the liner solely from an abrasion resistant material such as carbidic cast iron, either unalloyed, or an alloyed cast iron such as nickel-chromium white cast iron. It thus proposes a composite liner of such material and a back of a softer and tougher metal or alloy, produced by a double casting operation in which a first metal is cast, and the second metal is cast against the first metal. Evidently cognizant of the difficulty of achieving a bond between a solid and a cast metal, and being unable with a brittle cast iron to have recourse to hot rolling to overcome this difficulty, U.K. No. 928928 teaches that the first metal, typically the carbidic cast iron, is only partially solidified when the second metal is cast against it.

U.K. No. 928928 recognises the adverse consequences of oxidation of the surface of the first metal against which the second metal is to be cast. For this purpose, a chill mould is used to achieve rapid cooling of the first metal to its partially solidified condition. However, to further offset oxidation, a flux can be used to protect that surface; the flux being present in the mould before pouring the first metal or added in liquid form with the first metal.

Due to the backing being cast in the proposal of U.K. No. 928928, its properties will be inferior to those of a wrought backing. Also, the need for the first metal to be only partially solidified when casting the second metal provides a substantial constraint. Thus, close temperature control is imperative due to rapid cooling of the melt of the first metal and the need to cast the second metal while the first is only partially solidified. Pouring of the second metal with the first still too hot, that is, still containing liquid, will result in mixing of the metals, and loss of properties due to dilution; while, if the first metal is too cool, sound bonding is not likely. Also, the process necessitates two melts available at the same time and at well-controlled temperatures and, while some foundries will be able to meet this need, there remains the problem of co-ordinating pouring from the two ladles necessary. Additionally, there is the practical problem of feeding solidification shrinkage in the cast first metal with metal of the same composition. In the disclosure of U.K. No. 928928, such shrinkage can only be fed from the second metal, so that the first metal ultimately will contain regions of dissimilar composition. Additionally, the process of U.K. No. 928928 necessitates the surface of the first metal being horizontal, with severe limitations on the range of composite articles able to be produced. Further, the second metal has to be fed horizontally over that surface to avoid excessive mixing of the two melts; while flow-rate of the second metal over that surface has to be controlled so as to disturb the first metal as little as possible, for the same reason.

U.K. No. 977207 proposes a process for seamlessly clad products, such as pipes or rods, in which respective parts are of a soft steel such as stainless steel and a mild steel. In this process, a component of one of those steels is heated under vacuum or a non-oxidizing atmosphere and, while maintaining such environment, it is plunged rapidly into a melt of the second steel. The temperature of heating of the component of the first steel is to be to a temperature such that, on being plunged into the melt of the second steel, its surface becomes a semi-molten or highly viscous melt such that, on cooling of the two steels, they are welded together. The need for operation under a vacuum or a non-oxidizing atmosphere is a severe constraint, typically necessitating a sealed vessel in which the process is performed to exclude oxidation on heating the first component to near the melting point of the second metal. Also, the process again is limited in the range of shapes or forms of composite articles able to be produced. Additionally, the process is not amenable to use where the two metals differ significantly in melting point.

The severe disadvantages of operating with a non-oxidizing atmosphere also applies to the similar disclosures of U.K. Nos. 1053913 and 1152370. These disclosures differ essentially in the composition of their respective wear resistant materials; No. 1053913 proposes chromium-boron white cast irons containing molybdenum and vanadium, while No. 1152370 proposes nickel-boron cast irons containing molybdenum and vanadium. In each case the solid cast iron, in the form of crushed pig and pellets, is sealed to prevent atmosphere oxidation in a housing in which it is to provide a lining and heated therein under an inert atmosphere so as to melt. The housing is spun to centrifugally distribute. the molten cast iron, and the housing and melt thereafter are cooled. In addition to the disadvantage of the need for an inert atmosphere, and spinning of the housing until the cast iron has solidified, the disclosure of each of U.K. Nos. 1053913 and 1152370 has other disadvantages. The housing, of necessity, must have a melting point substantially above that of the cast iron, as the heating of the housing has to be limited to a temperature below that at which distortion or deformation of the housing will occur, particularly when spun. Additionally, the disclosure has severe limitations in relation to the shape of the resultant composite article, given the reliance on centrifugal distribution of the cast iron melt; while there is no disclosure as to how as a practical matter the high melting point housing can be provided with externally distributed cast iron.

U.K. No. 124797 is similar overall to U.K. Nos. 1053913 and 1152370. It differs principally in its use of eutectic Fe—C, plus higher melting point alloy, to form the cast iron.

U.S. Pat. Nos. 3,342,564 and 3,279,006 relate respectively to a composite article and a method for its production in which a melt of one metal is cast to fill a mould containing a solid second metal. Again, a vacuum or non-oxidizing atmosphere is necessary, due to the second metal being preheated to an elevated temperature such that melting of its surface occurs on casting of the first metal, and the need to protect against oxidation of the second metal.

Finally, U.K. No. 2044646 proposes hot welding together of a soft steel and a martensitic white cast iron. The welding together can be achieved by casting the white iron onto soft-steel plate, with the latter possibly being preheated. Alternatively, the cast iron can be cast first and, while still hot, the soft steel cast thereagainst. However, in the first of these alternatives, hot welding is likely only if surface melting of the soft-steel occurs, a situation not suggested by the optional nature of possibly preheating the soft steel. Also, oxidation of the soft-steel occurs to such an extent that, even with melting of the surface of the soft-steel, a sound bond between the soft-steel and cast iron is hard to achieve. Similar considerations apply in the second case, except that oxidation is of the cast iron during its cooling. Indeed, it is only by mechanical interlocking resulting from perforations or the like in the one metal, against which the other is cast, that the two metals are likely to be adequately secured together. However, such interlocking obviates the advantage of a soft-steel backing in protecting the brittle cast iron under impact loading, as the interlocking gives rise to localized stress concentration in the cast iron.

The present invention seeks to provide an improved composite metal article, and a process for its production which is more amenable to simple foundry practice and which enables a wider choice of metals.

The invention provides a method of forming a composite metal article, wherein a first metal component for the article is preheated and, with the first component positioned in a mould cavity to fill a portion of the cavity, a melt for providing a second metal component is poured so as to flow into the cavity over a surface of the first component; the temperature of said surface of the first component and the temperature of the melt being controlled so as to achieve wetting of said surface by the melt and attainment of a bond between the components on solidification and cooling of the melt which is strengthened by diffusion between the components and is substantially free of a fusion layer of said surface of the first component.

The required bond substantially free of a fusion layer is achieved if the surface of the first component is wetted by the melt which is to form the second component. Such wetting of that surface is found to occur if:

(a) a favourable surface energy relationship exists between the surface of the first component and the melt—a condition obtained if the surface is substantially free of oxide contamination but precluded by such contamination, and (a) the first component has a relatively high melting point and its surface, with the melt cast thereagainst, attains a sufficiently high temperature, most preferably a temperature equal to or greater than the liquidus temperature of the melt.

The bond generally is sharply defined but typically exhibits some solid state diffusion between the components. Also, while a fusion layer resulting from melting of the first layer substantially is avoided, the bond may be characterised by micro-dissolution, as distinct from melting, of the first component in the melt prior to solidification of the latter. Additionally, some epitaxial growth from the surface of the first component can occur, although this has not been seen to characterize the bond to any visible extent.

Thus, it is found that the attainment of a sound bond by casting a melt of a metal against a solid component is dependent, inter alia, upon the temperature prevailing at the surface of the solid component against which the melt is cast, and also the absence of oxidation of that surface. In general, the prior art has endeavoured to protect against oxidation by use of a vacuum or non-oxidizing atmosphere; a vacuum generally being preferred. However, as a practical matter, casting under vacuum is not well suited to industrial foundry practice and necessitates expensive apparatus. Particularly in repetitive casing operations, it also substantially increases production time. Similar comments apply to casting under a non-oxidizing atmosphere since, to provide adequate protection of the first component, casting under such atmosphere must be performed in a closed vessel similar to that necessary when operating under vacuum. That is, particularly when the solid first component is heated, as is necessary for a sound bond, the precautions necessary to protect its surface against oxidation increase with temperature and it is necessary that the melt for the second component be cast against that surface substantially in the absence of oxide on the surface.

It is found that a sound bond is achieved if the surface of the first component is cleaned to remove any oxide film and then protected, until the melt for the second component is cast against it, by a film of a suitable flux. A variety of fluxes can be used, while these can be applied in different ways. However, the flux most preferably is an active flux in that it not only prevents oxidation of the surface of the first component, but also cleans that surface of any oxide contamination remaining, or occurring, after cleaning of that surface. Suitable fluxes include Comweld Bronze Flux, which has a melting point of about 635° C. and contains 84% boric acid and 7% sodium metaborate, Liquid Air Formula 305 Flux (650° C., 65% boric acid, 30% anhydrous borax) and CIG G.P. Silver Brazing Flux (485° C. and containing boric acid plus borates, fluorides and fluoborates). Less active fluxes, such as anhydrous borax (740° C.), which simply provide a protective film but do not remove existing oxide contamination of the surface, can also be used provided that such contamination first is mechanically or chemically removed.

As indicated above, the temperature prevailing at the surface of the solid component against which the melt is cast is an important parameter. By this is meant the temperature at the interface between the components on casting the melt. However, while important, this parameter is secondary to the need for that surface of the solid component to be free of oxide, since attainment of an otherwise sufficient interface temperature will not achieve a sound bond if that surface is oxidized.

The interface temperature attained is dependent on a number of factors. These include the temperature to which the solid component is preheated, the degree of superheating of the melt when cast, the area of the surface of the solid component against which the melt is cast, and the mass of the solid and cast components. Also, where the respective metals of those components differ, further variables include the respective thermal conductivity, specific heat and density of those metals. However, notwithstanding the complex inter-relationships arising from these parameters, it has been found that a satisfactory bond can be achieved when the solid component is preheated to a temperature of at least about 350° C. The solid component preferably is preheated to a temperature of at least about 500° C.

It is highly preferred that the temperature to which the solid component is preheated and the degree of superheating of the melt are such that, on casting the melt, an interface temperature equal to or in excess of the liquidus temperature for the melt is achieved. It is found that the substantially instantaneous interface temperature is not simply the arithmetic means of the preheat and melt temperatures, weighted if necessary for differences in thermal conductivity, specific heat and density, as could be expected. Such arithmetic mean in fact results in erroneously low determination of substantially instantaneous interface temperature, since the calculation assumes that heat transfer from the melt to the solid component is solely by conduction. Calculation of the Nusselt number for the melt shows that convection heat transfer in the melt also is important and, when this is taken into account, it shows the substantially instantaneous interface temperature may be up to about 150° C. to 200° C. higher than the arithmetic mean of the preheat temperature of the solid component and the melt temperature.

The requirement that an interface temperature equal to or above the liquidus temperature of the melt be attained means that the invention principally is applicable where the solid first component has a melting range commencing at a temperature at least equal to the liquidus of the melt to provide the second component. Also, it is to be borne in mind that while reference is made in the preceding paragraph to the substantially instantaneous interface temperature, that reference is by way of example. That is, the required interface temperature need not be attained instantaneously, and may be briefly delayed such as due to a temperature gradient with the first component. It also should be noted that the invention can be used where the melt to provide the second component is of substantially the same composition as the first component; the first and second components thus having substantially the same melting range. In such case, it remains desirable that the surface of the first component against which the melt is cast still attains, on casting of the melt, a temperature at least equal to the liquidus temperature of the melt, but that the body of the first component acts as a heat sink which quickly reduces that surface temperature before significant fusion of the surface occurs. Similarly, the invention can be applied where the first component has a melting range commencing below that of the material for the second component, provided such quick cooling can prevent significant surface fusion of the first component; although such lower melting range first component is not preferred.

Attainment of a sufficient interface temperature is achieved by a balance between preheating of the first component, and the extent of superheating of the melt to provide the second component. The preheating preferably is to a temperature in excess of 350° C., more preferably to at least 500° C. The melt preferably is superheated to a temperature of at least 200° C., most preferably at least 250° C., above its liquidus temperature. However, in the case of aluminium bronzes such as hereinafter designated which are highly prone to oxidation, it can be desirable to drop these limits to 100° C. and 150° C. respectively, with a corresponding increase in preheating of the substrate.

The use of a flux and attainment of a sufficient interface temperature enables a sound bond to be achieved between similar metals and also between dissimilar metals. We have found that these factors enable such bond to be achieved in casting a stainless steel against a mild steel, or an alloy steel such as a stainless steel. A sound bond also similarly is round to be achieved in casting a cast iron, for example, a white cast iron such as a chromium white cast iron, against a mild steel, an alloy steel such as a stainless steel, or cast iron such as a white cast iron. Additionally, cobalt-base alloys similarly can be cast against a mild steel or an alloy steel to achieve a sound bond therebetween. Moreover, similar results can be achieved in casting nickel alloys, such as low melting point nickel-boron alloys, and aluminium bronzes against mild steel or alloy steels.

Stainless steels with which excellent results can be achieved, either as the solid first component or the cast second component, include those such as austenitic grades equivalent to AISI 316 or AS 2074-H6A, having 0.08 wt. % maximum carbon, 18 to 21 wt. % chromium, 10 to 12 wt. % nickel and 2 to 3 wt. % molybdenum, the balance substantially being iron. AISI 304 stainless steel, with 0.08 wt. % maximum carbon, 18 to 21 wt. % chromium, 8 to 11 wt. % nickel, and the balance substantially iron, also can be used.

Suitable cobalt base alloys include those of compositions typified by $(Co,Cr)_7C_3$ carbides in an eutectic structure and a work hardenable matrix, such as compositions comprising 28 to 31 wt. % chromium, 3.5 to 5.5 wt. % tungsten, 3.0 wt. % maximum iron, 3.0 wt. % maximum nickel, 2.0 wt. % maximum manganese, 2.0 wt. % maximum silicon, 1.5 wt. % maximum molybdenum, 0.9 to 1.4 wt. % carbon and the balance substantially cobalt. A cobalt base alloy having the nominal composition 29 wt. % chromium, 6.3 wt. % tungsten, 2.9 wt. % iron, 9.0 wt. % nickel, 1.0 wt. % carbon and the balance substantially cobalt, also has been found to be suitable.

Cast irons used as the second component include chromium white irons, of hypo- or hyper-eutectic composition. For these the carbon content can range from about 2.0 to 5.0 wt. % while the chromium content can be substantially in excess of chromium additions used to decrease graphitization in cast iron. The chromium content preferably is in excess of 14 wt. % and may be as high as from 25 to 30 wt. %. Conventional alloying elements normally used in chromium white iron can be present in the component of that material. Particular chromium white irons found to be suitable in the present invention include:

(a) AS 2027 grade Cr-15, Mo-3, cast iron having 2.4 to 3.6 wt. % carbon, 0.5 to 1.5 wt. % manganese, 1.0 wt % maximum silicon, 14 to 17 wt. % chromium and 1.5 to 3.5 wt. % molybdenum, the balance apart from incidental impurities being iron.

(b) AS 2027 grade Cr-27 cast iron having 2.3 to 3.0 wt. % carbon, 0.5 to 1.5 wt. % manganese, 1.0 wt. % maximum silicon, 23 to 30 wt. % chromium, and 1.5 wt % maximum molybdenum, the balance apart from incidental impurities being iron.

(c) austenitic chromium carbide iron having 2.5 to 4.5 wt. % carbon, 2.5 to 3.5 wt. % manganese, 1.0 wt. % maximum silicon, 25 to 29 wt. % chromium, and 0.5 to 1.5 wt. % molybdenum, the balance apart from incidental impurities being iron.

(d) complex chromium carbide iron having 4.0 to 5.0 wt. % carbon, 1.0 wt. % maximum manganese, 0.5 to 1.5 wt. % silicon, 18 to 25 wt. % chromium, 5.0 to 7.0 wt. % molybdenum, 0.5 to 1.5 wt. % vanadium, 5.0 to 10.0 wt. % niobium, and 1.0 to 5.0 wt. % tungsten, the balance apart from incidental impurities being iron.

(e) complex chromium carbide iron having 3.5 to 4.5 wt. % carbon, 1.0 wt. % maximum manganese, 0.5 to 1.5 wt. % silicon, 23 to 30 wt. % chromium, 0.7 to 1.1 wt. % molybdenum, 0.3 to 0.5 wt. % vanadium, 7.0 to 9.0 wt. % niobium, and 0.2 to 0.5 wt. % nickel, the balance apart from incidental impurities being iron.

Suitable nickel alloys include nickel-boron alloys conventionally applied by hard-facing and characterized by chromium borides and chromium carbides in a relatively low melting point matrix. Particularly preferred compositions are those substantially of eutectic composition and have 11 to 16 wt. % chromium, 3 to 6 wt. % silicon, 2 to 5 wt. % boron, 0.5 to 1.5 wt. % carbon and optionally 3 to 7 wt. % iron the balance, apart from incidental impurities being nickel. Exemplary compositions are:

(a) 77 wt. % nickel, 14 wt. % chromium, 4.0 wt. % silicon; 3.5 wt. % boron and 1.0 wt. % carbon, plus incidental impurities; and (b) 13.5 wt. % chromium, 4.7 wt. % iron, 4.25 wt. % silicon, 3.0 wt. % boron, 0.75 wt. % carbon and, apart from incidental impurities, a balance of nickel.

Aluminium bronze compositions suitable for use in the invention vary extensively but, excluding impurities, are typified by:

(a) 86 wt. % minimum copper, 8.5 to 9.5 wt. % aluminium and 2.5 to 4.0 wt. % iron (UNS No. C95200);

(b) 86 wt. % minimum copper, 9.0 to 11.0 wt. % aluminium, and 0.8 to 1.5 wt. % iron (UNS No. C95300);

(c) 83 wt. % minimum copper, 10.0 to 11.5 wt. % aluminium, 3.0 to 5.0 wt. % iron, 2.5 wt. % maximum nickel (plus any cobalt), and 0.5 wt. % maximum manganese (UNS No. C95400);

(d) 78 wt. % minimum copper, 10.0 to 11.5 wt. % aluminium, 3.0 to 5.0 wt. % iron, 3.0 to 5.5. wt. % nickel (plus any cobalt), and 3.5 wt. % maximum manganese (UNS No. C95500);

(e) 71 wt. % minimum copper, 7.0 to 8.5 wt. % aluminium, 2.0 to 4.0 wt. % iron, 11.0 to 14.0 wt. % manganese, 1.5 to 3.0 wt. % nickel, 0.10 wt. % maximum silicon, and 0.03 wt. % maximum lead (f) 79 wt. % minimum copper, 8.5 to 9.5 wt. % aluminium, 3.5 to 4.5 wt. % iron, 0.8 to 1.5 wt. % manganese, 0.10 wt. % maximum silicon and 0.03 wt. % maximum lead (UNS No. C95800); and (g) 12.5 to 13.5 wt. % aluminium, 3.5 to 5.0 wt. % iron, 2.0 wt. % maximum manganese, 0.5 wt. % maximum other elements, balance substantially copper (UNS No. C62500).

The aluminium bronze alloys exhibit poor castability, as is appreciated. A problem with their use in the present invention is the pronounced tendency for their melts to oxidize, and this can complicate their use in the invention as in other applications. However, protecting the melt against oxidation, such as by melting under a flux cover, enables these alloys also to be cast against the securely bonded to a solid first component, such as a mild steel substrate. However, because of the tendency for the melt to oxidize, it can be advantageous to limit the extent of superheating of the melt and to achieve the required first component/melt interface temperature by increasing the temperature to which the first component is preheated.

The specifically itemised castable metals suitable for use in the invention as the second component will be recognised as surfacing materials conventionally applied by hardfacing by weld deposition. Typically, such metals are applied to provide wear resistant facings. However, in the case of stainless steels, which can provide abrasion resistance at low or medium temperatures, the purpose of its use in a composite article may be in part or wholly to achieve corrosion resistance for the other component of the article. Thus, while principally concerned with composite articles having abrasion resistance by appropriate selection of the metal of one component, the invention also is concerned with articles for use in environments other than those in which abrasion resistance is required. Also, as indicated by the ability to cast for example a cast iron against a cast iron, the composite article of the invention can be applied to rebuilding a worn or damaged part of an article; the first and second components in that case being of substantially the same or similar composition if required. In such rebuilding, the worn or damaged part of an article can be machined, if required, to provide a more regular surface thereof against which a melt of rebuilding metal is to be cast. However, such machining may not be necessary for a sound bond to be achieved, provided that an oxide-free surface is available against which to cast the melt.

The solid first component may be preheated in the mould or prior to being placed in the mould while the type of mould used can vary with the nature of the preheating. When heated in the mould, the preheating may be by induction coils, or by flame heating. When heated prior to being placed in the mould, resistance, induction or flame heating can be used or, alternatively, the solid first component can be preheated in a muffle or an induction furnace. What is important, in each case, is that at least the surface of that component against which the melt for the second component is to be cast is thoroughly cleaned mechanically and/or chemically and protected, prior to preheating to a temperature at which re-oxidation will occur, by a suitable flux. Normally, in such cases, the flux is applied as a slurry, such as by the flux being painted on at least that surface of the solid first component. Alternatively, the flux can be sprinkled on the surface in powder form; provided, where preheating then is to be by a flame, the surface has been partially heated to a temperature at which the flux becomes tacky. Particularly where the surface of the first component against which the melt is to be cast is of complex form, the flux alternatively can be applied by dipping the first component into a bath of molten flux. In each of these methods of applying the flux, the first component can be stored, once coated with the flux, until required for preheating. Alternatively, the component may be preheated immediately after the flux is applied.

Where the flux is applied by dipping the solid first component in a bath of molten flux, a variant on the above described methods of preheating can be adopted. In this, the preheating can be effected at least in part by the solid first component being soaked in the bath of molten flux until it attains a sufficient temperature, which may be below, substantially at, or above the required preheat temperature. The component then can be transferred to the mould and, after further induction or flame heating or after being allowed to cool to the required temperature, the melt to provide the second component is cast thereagainst.

Where preheating of the solid first component is at least in part by flame heating, that component may be positioned in a mould defining a firing port enabling a heating flame to extend into the mould cavity and over that component; the flame preheating the component and also heating the mould. While not essential, a reducing flame can be used to maintain in the mould a reducing atmosphere so as to further preclude oxidation of the surface of the first component. The flame may be provided by a burner adjacent to the firing port for generating the reducing flame.

The mould for use in flame heating may be constructed in portions which are separable. The portions may be spaced by opposed side walls and, at one end of those walls, the firing port can be defined, with an outlet port for exhausting combustion gases from the flame being defined at the other ends of the side walls. The side walls may be separable from the mould portions, or each may be integral with the same or a respective mould portion. Preferably, an inlet duct is provided at the firing port for guiding the flame into the interior of the mould. Where the first component has an extensive surface over which the melt is to be cast, such as a major face of a flat plate substrate, the width of the firing port in a direction parallel to that surface may be substantially equal to the dimension of the substrate surface in that direction. The duct may have opposed side walls which diverge toward the firing port to cause the reducing flame to fan out to a width extending over substantially the full surface of the substrate to which the melt is to be cast. Also, the duct may have top and bottom walls which converge toward the firing port to assist in attaining such flame width. The duct may be separable from the mould, integral with one mould portion or longitudinally separable with a part thereof integral with each mould portion.

The flame heating may be maintained until completion of casting of the melt. After pouring the melt and before the latter has solidified, the burner may be adjusted to give a hotter, slightly lean flame. Solidification of the top surface of the melt can be delayed by such lean flame, so that the melt solidifies preferentially from the melt/first component interface, rather than simultaneously from that interface and top surface. Such solidification also can minimise void formation due to shrinkage in the unfed cast metal.

In such flame preheating, the pouring arrangement most conveniently is such as to rapidly distribute the melt over all parts of the surface of the first component on which it is to be cast and to maximise turbulence in the melt. Such rapid distribution and turbulence promotes heat transfer and a high, uniform temperature at the interface between the poured melt and the surface first component. Rapid distribution and turbulence also facilitates breaking-up and removal of any oxide film on the melt. It also would remove any residual oxide from of that surface, although reliance on this action without prior cleaning and use of a flux produces a quite inferior bond.

Rapid distribution of the melt over the substrate surface of the first component and turbulence in the melt can be generated by a mould having a pouring basin into which the melt is received, and from which the melt flows via a plurality of sprues of which the outlets are spaced over that surface. This arrangement functions to evenly and simultaneously pour the melt onto all areas of the surface; thereby reducing the distance the melt has to flow and aiding in achieving a high and uniform temperature at the melt-first component interface. The arrangement also increases turbulence in the melt over, and facilitates wetting of, that surface.

One advantage of a reducing flame in such preheating of the first component is that it offsets any tendency for oxidation of the melt resulting from its rapid distribution and turbulence. Also, such turbulence can cause erosion, by localized macro-dissolution of metal of the first component, at points of impingement of the melt with the surface of that component. It therefore can be beneficial to use an arrangement for pouring the melt which establishes substantially non-turbulent, progressive mould filling. In one such arrangement, the invention uses a mould having a horizontally extending gate which causes the melt to enter a mould cavity in a plane substantially parallel to, and slightly above the surface of the first component on which the melt is to be cast. This enables the melt to progress in substantially non-turbulent flow across that surface, with minimum division of the flow, thereby inhibiting oxidation of the melt. Thus, the exposure of fresh, non-oxidized metal of the melt to an oxidizing environment is minimised.

The placement of the gate most conveniently is such that the initial melt which enters the mould flows across the surface of the pre-heated first component, further heating that surface. Subsequent incoming liquid metal displaces the initial metal which entered the mould cavity, thereby ensuring that maximum heat is imparted to the surface before solidification commences. Just prior to pouring, the mould cavity may be closed with a cope-half mould, with the molten metal being run into the cavity through a vertical down sprue and horizontal runner system. For small castings, this system permits several castings to be made in the same moulding box from a single vertical down-sprue feeding into separate runners for each casting. Such casting practice can be used to produce a bond interface on a horizontal, inclined or even vertical, surface of the first component.

In such arrangement providing substantially non-turbulent flow of the melt in the mould, flame heating again can be used. However, in this instance, it is necessary to position the first component (which may have been partially preheated) in the drag portion of the mould and, before positioning the cope portion of the mould, to effect flame heating from above. As an alternative, the mould can be fully assembled and preheating effected or completed therein by induction heating.

Where flame heating is used, it is preferred that the flux be applied by dipping in a melt of the flux or by painting on a slurry of the flux. If, as an alternative, it is required to apply the flux as a powder, it is preferable that the first component be slightly heated to about 150° to 200° C., such as in a muffle furnace, so that the flux becomes tacky and is not blown from the surface of the first component by the heating flame.

When the flux is applied by dipping the first component into a bath of molten flux, the flux is applied at least over the surface of that component against which the melt is to be cast. Preferably, the component is immersed in the bath so as to be fully coated with flux and also at least partially preheated in that bath. Once a flux coating is provided, the first component then is positioned in a mould and a melt to provide the second component poured into the mould so that the melt flows over the surface of the first component. Preferably the first component is suspended in the bath of molten flux until its temperature exceeds the melting point of the flux. The component is then withdrawn from the flux bath with a coating of a thin, adherent layer of the flux thereon. The melt displaces the thin flux coating, remelting the latter if necessary, thereby exposing the clean surface of the first component so that wetting and bonding take place. Clearly, the flux employed must have a melting point which is sufficiently low to permit quick remelting of the flux, if frozen at the time the melt is poured into the mould. At the same time the molten flux must be able to withstand temperatures sufficiently high that the steel substrate can be adequately preheated. A sufficient temperature can be achieved with several fluxes during suspension, or dipping, of the first component in the bath of molten flux. However, where the temperature of the flux bath is insufficient for this, or where the heat loss from the first component between forming the flux coating and pouring the melt is too great, the first component can be further preheated in the mould, such as by induction or flame heating.

In order that the invention may more readily be understood, description now is directed to the accompanying drawings, in which.

Figure 1:
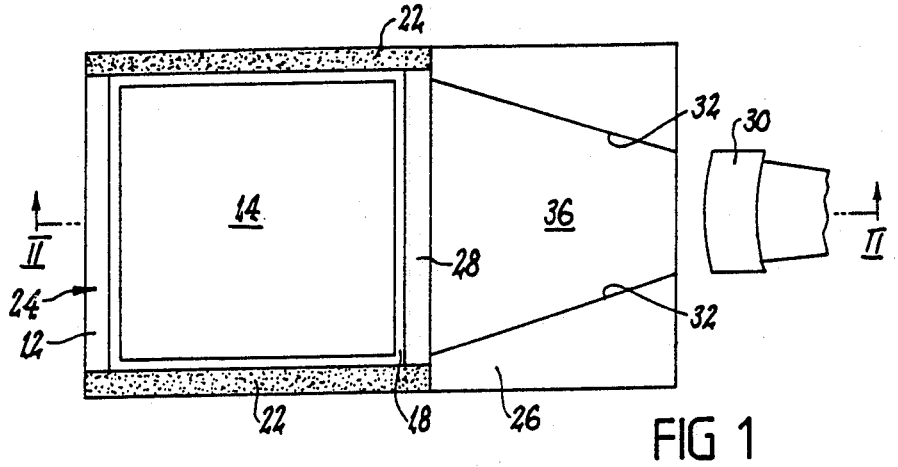
FIG. 1 shows, in vertical section, a furnace suitable for use in a first form of the invention.
Figure 2:
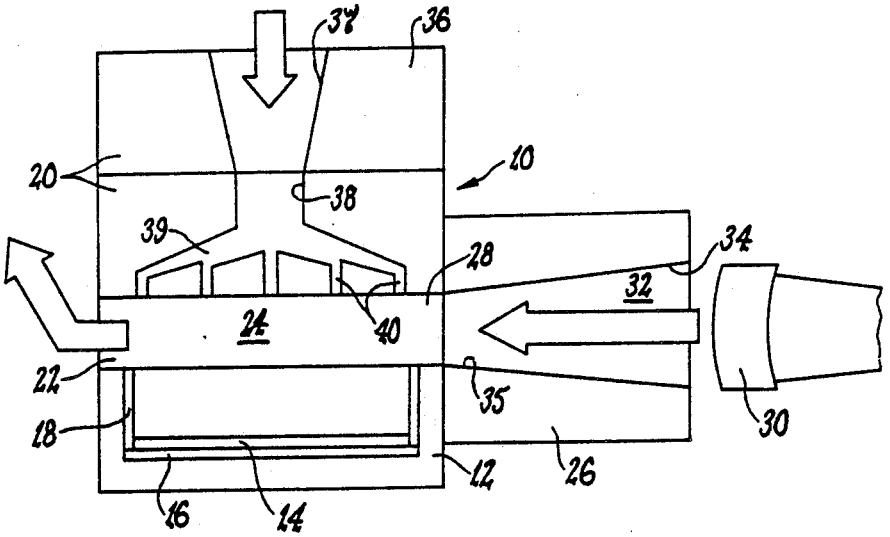
FIG. 2 is a horizontal section, taken on line II—II of FIG. 1.

With reference to FIGS. 1 and 2, mould 10, formed from a bonded sand mixture, has a lower mould portion 12 in which is positioned a ductile first component or substrate 14 on which a wear-resistant component is to be cast. A layer 16 of ceramic fibre insulating material insulates the underside of substrate 14 from the mould portion 12, while a layer 18 of such material lines the side walls of portion 12 around and above substrate 14. Mould 10 also has an upper portion 20, spaced above portion 12 by opposed bricks 22. The spacing provided between portions 12,20 by bricks 22 is such as to define a transverse passage 24 through mould 10. Across one end of passage 24, the mould is provided with an inlet duct 26; the junction of the latter with passage 24 defining a firing port 28. A burner 30, operable for example on gas or oil, is positioned adjacent to the outer end of duct 26 for generating a flame for preheating substrate 14 and mould portions 12,20.

Duct 26 has sidewalls 32 which diverge from the outer end to firing port 28. This arrangement causes the flame of burner 30 to fan out horizontally across substantially the full width of port 28 and, within mould 10, to pass through passage 24 over substantially the entire upper surface of substrate 14. Upper and lower walls 34,35 converge to port 28, and so assist in attaining such flame width in mould 10. The flame most conveniently extends through the end of passage 24 remote from port 28; with combustion gases also discharging from that remote end.

Upper portion 20 of the mould has a section 36 defining a pouring basin 37 into which is received the melt of wear-resistant metal to be cast on the upper surface of substrate 14. From basin 37, the melt is able to flow under gravity through throat 38, along runners 39, and through the several sprues 40 in portion 20. The lower ends of sprues 40 are distributed horizontally, such that the melt is poured evenly and simultaneously onto all areas of the upper surface of substrate 14.

Figure 3:
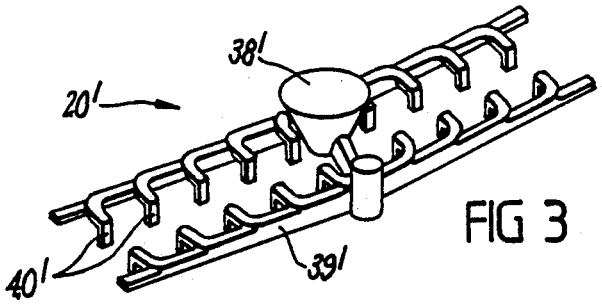
FIG. 3 is a perspective view of a pouring mould pattern suitable for making a mould component of a furnace as in FIGS. 1 and 2.

FIG. 3 shows a mould pattern for use in producing the upper portion 20 of a mould similar to that of FIGS. 1 and 2. In FIG. 3 corresponding parts are shown by the same numeral primed.

Castings made in a mould as shown in FIGS. 1 and 2 include steel substrates measuring 300 mm×300 mm and 10 mm thick. The steel plates were inserted in the lower mould portion with insulation under and around the plates as described earlier. The moulds were levelled, flux was sprinkled on the steel to cover its upper surface, the mould built up in the manner discussed, and the mould was initially gently heated to make the flux tacky and adhere to the surface. Two sizes of castings were made using a high chromium white cast iron, one type had 40 mm overlay on 10 mm steel plate, the other had 20 mm on 10 mm.

For the 4:1 ratio castings, the substrate was preheated by means of the burner generating a reducing flame in the mould, and 30 kg of high chromium white iron was poured at a temperature of approximately 1600° C. into the pouring basin. The iron surface was kept liquid for about 8 minutes and the burner was then turned off. A thermocouple against the bottom surface of the substrate reached a temperature of 1250° C. approximately 2 mins. after pouring. Ultra-sonic measurement indicated 100% bonding, which was subsequently confirmed by surface grinding of the edges and of a diagonal cut through the casting, as well as extraction of 50 mm diameter cores by electro-discharge machining. The bond was free of any fusion layer due to melting of the steel.

For the 2:1 ratio castings, the substrate was preheated and 15 kg of the iron was poured at a temperature of about 1600° C. The white iron surface could not be kept liquid as long as with the 4:1 ratio castings, but was liquid for about 5 minutes. The thermocouple against the bottom of the plate reached 1115° C. approximately 3 minutes after pouring. For this size casting sound bonding over the full interface between the substrate and cast metal again is achieved.

In addition to the castings described above, a number of further castings were made on 200 mm×50 mm×10 mm steel substrates. The most suitable pouring mould in this case was found to be in the shape of a funnel with a long narrow slot at the bottom. The slot extended for the full length of the substrate and was narrow enough for the liquid iron to issue from its full length simultaneously. With a preheat of 350° C. and a liquid iron pour temperature of 1570° C., bonding was achieved over more than 95% of the total area. By increasing the preheat temperature, bonding over 100% of the area can readily be achieved with this size of substrate.

The castings described have been shown to give complete bonding on 300 mm×300 mm×10 mm test plates of mild steel with white iron to steel ratios of 4:1 and 2:1. Higher and lower ratios are possible; the lower ratios depending in part on substrate thickness and the rate of heat loss from the metal for optimum bonding.

Inherent in the invention is a high degree of freedom with respect to the geometrical shape of the substrate and the finished article. The invention has significant advantages compared to other methods in that it enables the direct casting of hard, wear-resistant metals, such as high chromium white iron, onto ductile steel substrates. The finished article can combine the well documented wearing qualities of for example white iron with the good mechanical strength and toughness, machining properties and weldability of low carbon steel. The direct metallurgical bond between the white iron and the steel results in very high bond strength. The invention is especially suitable for producing hardfacing layers of thickness exceeding those which may be conveniently laid down by welding processes.

The temperature to which the substrate is preheated can vary considerably. The temperature is limited by the need to prevent oxidation, the melting point of the material of the substrate, the need to minimise grain growth, and the type of flux. Within these limits, a high preheat temperature is advantageous. The minimum preheat temperature will depend on the thickness ratio of cast component to substrate, and on the size and shape of the components. For the above-mentioned 4:1 castings, a pre-heat temperature of 500° C. was found to be just sufficient; while for the 2:1 castings, a minimum preheat of 600° C. was found to be necessary.

An important parameter is the temperature at the interface between the cast liquid and the substrate. This enables a lowering of melt temperature with a corresponding increase in substrate preheat temperature, and vice versa. However, it is preferable for the melt to be superheated sufficiently to allow any flux and any dislodged scale to rise to the surface of the cast melt, and to attain the required interface temperature for a satisfactory bond between the substrate and cast component. For all casting alloys, with the exception of aluminium bronzes discussed herein, superheating by at least 200° C. above the liquidus temperature is preferred, most preferable at least 250° C. above that temperature, in order to achieve the required interface temperature on casting.

Particularly with the flux provided over the substrate surface on which the melt is to be cast, the reducing flame need provide only a mildly reducing atmosphere over that surface during preheating. For such atmosphere, a flame provided by an air deficiency of between 5% and 10% can be used.

Figure 4:
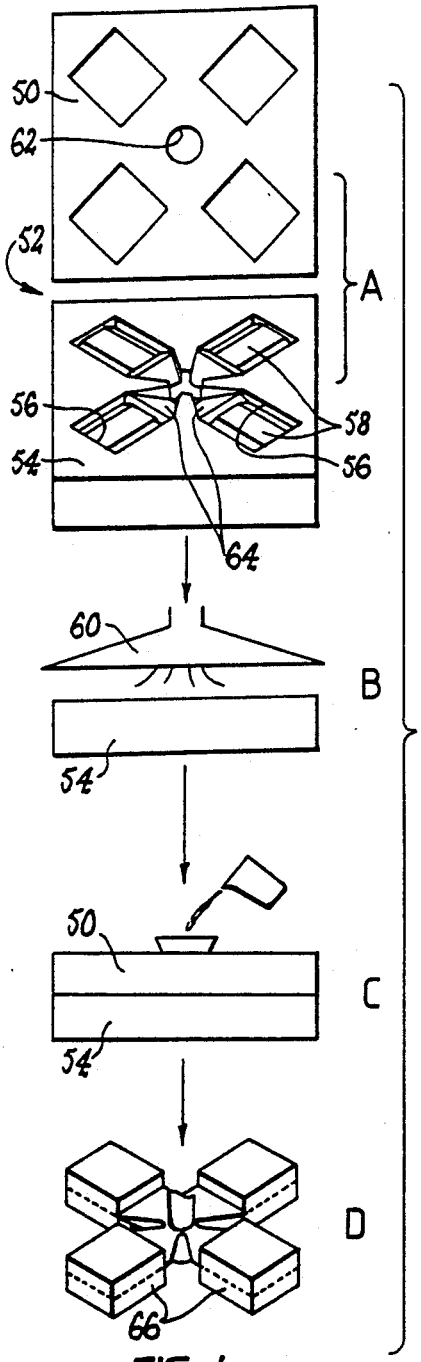
FIG. 4 shows a flowchart depicting the manufacture of composite metal articles in a second form of the invention.

With reference to FIG. 4, there is shown at A an underside view of the cope portion 50 of mould 52, and the top plan view of drag portion 54 thereof. In each of several mould cavities 56, there is a respective chamfered substrate 58, of which the upper surface of each has been painted with a flux slurry. As shown at B, substrates 58 are preheated by flame from above, prior to positioning cope portion 50, using a reflector 60 to facilitate preheating. As shown at C, cope portion 50 then is positioned and a melt to be cast against the upper surface of each substrate is poured into the mould via cope opening 62. The melt flows horizontally via gates 64, to each cavity 56, and flows along each substrate 58 across the full width of each. As indicated at D, the resultant composite articles 66 are knocked-out, and thereafter dressed in the normal manner.

Operation as depicted in FIG. 4 has been used to produce various sizes of hammer tips for use in sugar cane shredder hammer mills. The hammer tips were made with mild steel substrates and a facing bonded thereto of high chromium white cast iron. Dimensions of hammer tips produced have been as follows:

| Substrate dimensions (mm) | Cast overlay thickness (mm) |
|---|---|
| 80 × 90 × 25 (thick) | 25 |
| 90 × 90 × 25 (thick) | 20 |
| 76 × 50 × 20 (thick) | 18 |

Risers have been employed in producing the hammer tips to ensure fully sound castings were produced. In these types of hammer tip, substantial chamfers have been machined into the substrates prior to pouring, in order to permit the production of hammer tips with a more complete coverage of wear-resistant alloy on the working face than has hitherto been possible with brazed composites. These hammer tips have also used pre-machined substrates, wherein drilled and tapped holes required for subsequent fixing of the hammer tip to the hammer head have been formed prior to production of the composite. The threaded holes have been protected with threaded metal inserts during the casting operation. The flexibility of being able to use premachined bases in this way has overcome the problems associated with drilling and tapping blind holes in an already bonded composite.

The hammer tips were found to be characterized by a sound diffusion bond, using casting temperatures comparable to those indicated with reference to FIGS. 1 to 3.

The bonds were diffusion bonds exhibiting no fusion layer due to melting of the substrate surfaces.

Figure 5:
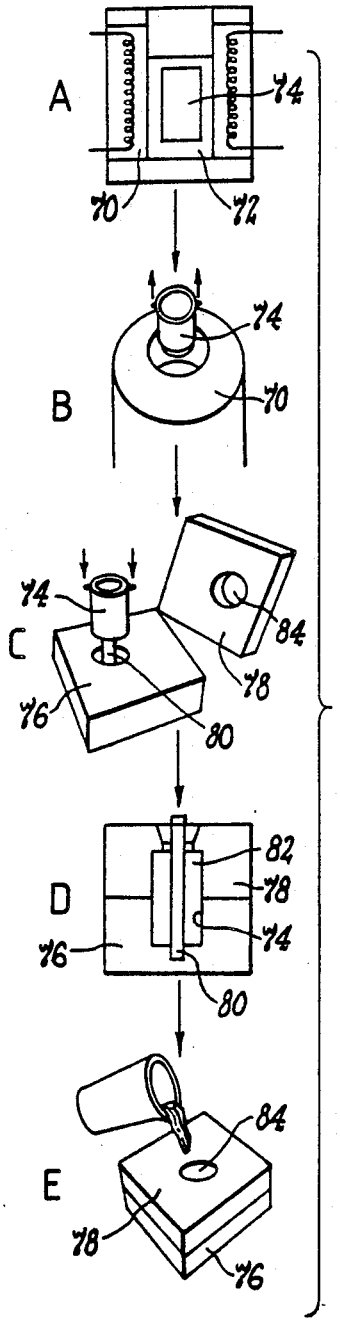
FIG. 5 shows a flow chart depicting a third form of the invention.

With reference to FIG. 5, there is shown at A a furnace 70 providing a bath of molten flux 72 in which is immersed a tubular steel component 74. The latter is preheated to a required temperature in flux 70. As indicated at B and C, heated component 74 coated with flux, is withdrawn from furnace 70 and, after draining excess flux, component 74 is lowered into the drag half 76 of a mould and the cope half 78 of the latter is positioned. In the arrangement illustrated, the mould includes a core 80 which extends axially through component 74, to leave an annular cavity 82 between core 80 and the inner surface of component 74. With cope half 78 positioned as shown at D, a melt of superheated metal is cast as at E, via cope opening 84, to fill cavity 82.

Trials with the above described Liquid Air flux (m.p. 650° C.) have been carried out in a procedure essentially as described with reference to FIG. 5, using steel substrates comprising:

(a) 200 mm long×50 mm wide×10 mm thick, for which bonding has been produced with cast overlay thicknesses of 40 mm, 30 mm and 20 mm (i.e. 4:1, 3:1 and 2:1 casting ratios); and (b) 80 mm square×25 mm thick, for which good bonding has been produced with a cast overlay thickness of 25 mm (i.e. 1:1 casting ratio).

It has been found that the flux layer which adheres to the substrate upon its withdrawal from the molten flux bath is relatively thick, and that mechanical scraping away of the majority of this adherent flux to leave only a very thin layer produced a better bond. A lower melting point flux can be used and has the advantages of being more fluid at the required working temperature, thereby draining better upon withdrawal of the substrate as well as being more readily remelted during casting. However, in the latter regard, it should be noted that it is not necessary that the flux freezes between removal of the substrate from the bath and casting the melt or the application of flame or other preheating. Also, use of a lower melting point flux facilitates production of even smaller casting ratio articles than described herein.

While the articles described herein are of planar form, it should be noted that the invention can be used to provide articles of a variety of forms. Thus, the invention can be used in the production of, for example, cylindrical articles having a wear-resistant material cast on the internal and/or external surface thereof, curved elbows, T-pieces and the like. Representative further composite articles further exemplifying the flexibility and range of possibilities with the present invention are set out in the following table, in which:

Method I designates manufacture in accordance with the procedures described with reference to FIGS. 1 to 3, and Methods II and III designate manufacture in accordance with FIGS. 4 and 5, respectively.

TABLE

| Substrate Component | Cast Component | Method |
|---|---|---|
| | A. Alloy White Cast Iron | |
| 1. 200 × 50 × 10 mild steel plates | Each of 40, 30, 20 and 10 mm on substrate main faces. | Each of I, flame preheating and III, flux bath preheating. |
| 2. 300 × 300 × 20 mm thick steel plates | Each of 40 and 20 mm on substrate main faces. | I, flame preheating. |
| 3. 900 × 75 × 50 mm steel bar | 50 mm thickness on main face (heat/abrasion resistant alloy complex Cr-carbide iron). | I, flame preheating articles for use as sinter plant griller bars. |
| 4. Steel plate of: | Cast on substrate mainfaces | Both I and II, flame preheating - articles for use as hammer tips in sugar cane shredder. |
| (a) 80 × 70 × 25 mm | 25 mm | |
| (b) 90 × 80 × 25 mm | 25 mm | |
| (c) 76 × 50 × 20 mm | 20 mm | |
| (d) 90 × 90 × 20 mm | 25 mm | |
| 5. Round steel bar of: | Cast on cylindrical cladding | III, flux bath preheating. |
| (a) 40 mm diameter | 30 mm wall thickness | |
| (b) 50 mm diameter | 25 mm wall thickness | |
| (c) 60 mm diameter | 20 mm wall thickness | |
| (d) 70 mm diameter | 15 mm wall thickness | |
| 6. Hollow steel pipes of: | Cast to provide: | III, flux bath heating. |
| (a) 100 mm outside diameter, and 10 mm wall thickness. | Internal claddings of each of 15 mm and 19 mm. | |
| (b) 75 mm outside diameter, and 10 mm wall thickness. | External cladding of 12.5 mm with simultaneous internal claddings of each of 3.5 and 7.5 mm thicknesses. | |
| (c) 90° pipe bend of 75 mm outside diameter, 5 mm wall thickness and 63 mm centreline radius of curvature. | Internal cladding of 7 to 10 mm thickness. | |
| 7. AISI 304 stainless steel, 90 × 90 × 10 mm thick | Cast 25 mm on main substrate faces. | II, induction preheating. |
| 8. Composite substrate 90 × 90 × 25 mm with 15 mm thick base of mild steel and 10 mm thick white iron overlay | Cast 25 mm on main substrate white iron overlay surface. | II, induction preheating. |
| | B. Stainless Steel | |
| 9. (a) 90 × 90 × 10 mm thick mild steel | AISI 316 stainless steel cast 25 mm on main substrate surface. | II, induction preheating. |
| (b) 90 × 90 × 70 mm thick plate | Cast on main face 70 mm thickness. | II, induction preheating and III, flux bath preheating. |
| | C. Cobalt Base Alloy | |
| 10. 90 × 90 × 10 mm thick mild steel | Cast on main substrate face 25 mm thickness. | II, induction preheating. |
| | D. Aluminium Bronze Alloy | |
| 11. 90 × 90 × 10 mm thick mild steel plates | Cast 25 mm on substrate main faces. | II, with flame preheating and II with induction preheating. |
| | E. Nickel Alloy | |

TABLE-continued

| Substrate Component | Cast Component | Method |
|---|---|---|
| 12. 90 × 90 × 10 mm thick mild steel plate | Cast 25 mm on substrate main faces. | II, with induction preheating. |

With each of the examples detailed in the table, sound bonds were achieved in each case. It was found that attainment of a sound bond was relatively insensitive to the choice of flux, or the method of preheating, in any of those cases. Generally, preheating of the substrate component was to a temperature of about 800° C., with the melt poured at a temperature of about 1600° C. for all alloys except aluminium bronze. The above-mentioned CIG Silver Brazing Flux and Liquid Air 305 Flux both were found to be highly suitable, particularly in method III.

The melt used in Example 12 was 14.7 wt. % aluminium, 4.3 wt. % iron, 1.6 wt. % manganese, the balance, apart from other elements at 0.5 wt. % maximum, being copper. As with other aluminium bronze compositions detailed herein, this melt exhibited a tendency to oxidation, and precautions are necessary to prevent this. To the extent that this difficulty could be overcome, sound bonding at clean interface surfaces results. The melt liquidus is approximately 1050° C. and the melt was poured at 1350° C. with the substrate preheated to about 800° C. The problem of melt oxidation can be reduced by lowering the melt superheating, with a corresponding increase in substrate preheating and/or use of a flux cover for the melt.

The melt used in Example 13 had a composition of 13.5 wt. % chromium, 4.7 wt. % iron, 4.25 wt. % silicon, 3.0 wt. % boron, 0.75 wt. % carbon and the balance substantially nickel. This melt had a liquidus temperature of approximately 1100° C., and was poured at approximately 1600° C. with the substrate preheated to approximately 800° C.

The bond achieved with the present invention was found to be of good strength. This is illustrated for a composite article comprising AISI 316 stainless steel cast against and bonded to mild steel. For such article, bond strengths of about 440 MPa were obtained with test specimens machined to have a minimum cross-section at the bond zone. Also with such article, an ultimate tensile strength of about 420 MPa was obtained in a testpiece with 56 mm parallel length, with the bond about halfway along that length; the total elongation of 50 mm gauge length being 32%. For articles in which the cast metal component is brittle, it is found that the bond is stronger than the component of the article of the cast metal. Thus, with hypoeutectic chromium white iron cast against and bonded to mild steel, bend tests showed fracture paths passed through the white iron, and not the bond zone.

We claim:

1. A composite metal article having a first component and a second component, wherein said second component is cast against a bond surface of the first component, said article being characterized by a diffusion bond between said components obtained on solidification of melt providing said second component substantially without fusion of said bond surface; wherein said first component is a ferrous metal and said second component is selected from the group consisting of a ferrous metal and a cobalt base alloy and said diffusion bond is formed by:

(a) applying a flux coating over said bond surface of said first component after rendering said surface substantially oxide-free;

(b) preheating said first component to a preheat temperature of about 350° to about 800° C.; and (c) pouring said melt of said second metal to provide said second component, said melt being poured at a superheated temperature and such that said melt flows over said bond surface to thereby displace said flux coating from said bond surface and wet said bond surface, said superheat temperature being substantially in excess of said preheat temperature, whereby said melt raises the temperature of said bond surface to achieve an initial temperature equilibrium between said surface and the melt, and a substantially instantaneous interface temperature therebetween which is at least equal to the liquidus temperature of the melt, such that on solidification of the melt said bond substantially in the absence of fusion of said bond surface is attained between the components.

2. A composite article as defined in claim 1, wherein said first component comprises a ferrous metal selected from the group consisting of mild steel, low alloy steels, and stainless steels.

3. A composite article as defined in claim 1, wherein said second component is selected from the group consisting of white cast irons, stainless steels, and cobalt-base alloys.

4. A composite article as defined in claim 1, wherein said first component is selected from the group consisting of mild steels, alloy steels including stainless steel and cast iron including chromium white cast iron, and wherein said second component is a white cast iron having from 2.0 to 5.0 wt. % carbon and chromium up to 30 wt. %.

5. A composite article as defined in claim 4, wherein chromium is present in excess of 14 wt. %, such as from 25 to 30 wt. %.

6. A composite article as defined in claim 4, wherein said white cast iron has a composition selected from the group consisting of:

(a) 2.4 to 3.6 wt. % carbon, 0.5 to 1.5 wt. % manganese, 1.0 wt. % maximum silicon, 14 to 17 wt. % chromium and 1.5 to 3.5 wt. % molybdenum, the balance apart from incidental impurities being iron;

(b) 2.3 to 3.0 wt. % carbon, 0.5 to 1.5 wt. % manganese, 1.0 wt. % maximum silicon, 23 to 30 wt. % chromium, and 1.5 wt. % maximum molybdenum, the balance apart from incidental impurities being iron;

(c) 2.5 to 4.5 wt. % carbon, 2.5 to 3.5 wt. % manganese, 1.0 wt. % maximum silicon, 25 to 29 wt. % chromium, and 0.5 to 1.5 wt. % molybdenum, the balance apart from incidental impurities being iron;

(d) 4.0 to 5.0 wt. % carbon, 1.0 wt. % maximum manganese, 0.5 to 1.5 wt. % silicon, 18 to 25 wt. % chromium, 5.0 to 7.0 wt. % molybdenum, 0.5 to 1.5 wt. % vanadium, 5.0 to 10.0 wt. % niobium, and 1.0 to 5.0 wt. % tungsten, the balance apart from incidental impurities being iron; and (e) 3.5 to 4.5 wt. % carbon, 1.0 wt. % maximum manganese, 0.5 to 1.5 wt. % silicon, 23 to 30 wt. % chromium, 0.7 to 1.1 wt. % molybdenum, 0.3 to 0.5 wt. % vanadium, 7.0 to 9.0 wt. % niobium, and 0.2 to 0.5 wt. % nickel, the balance apart from incidental impurities being iron.

7. A composite article as defined in claim 3, wherein said first component is selected from the group consisting of mild steel and alloy steels including stainless steels, and wherein said second component is an austenitic stainless steel having a composition selected from the group consisting of:

(a) 0.08 wt. % maximum carbon, 18 to 21 wt. % chromium, 10 to 12 wt. % nickel, 2 to 3 wt. % molybdenum and, apart from incidental impurities, a balance of iron; and (b) 0.08 wt. % maximum carbon, 18 to 21 wt. % chromium, 8 to 11 wt. % nickel and, apart from incidental impurities, a balance of iron.

8. A composite article as defined in claim 3, wherein said second component is a cobalt-base alloy having $(Co,Cr)_7C_3$ carbides in an eutectic structure and a work hardenable matrix, obtained with a composition selected from the group consisting of:

(a) 28 to 31 wt. % chromium, 3.5 to 5.5 wt. % tungsten, a maximum of 3.0 wt. % for each of iron and nickel, a maximum of 2.0 wt. % for each of manganese and silicon, 1.5 wt. % maximum molybdenum, 0.9 to 1.4 wt. % carbon and, apart from incidental impurities a balance of cobalt; and (b) substantially 29 wt. % chromium, 6.3 wt. % tungsten, 2.9 wt. % iron, 9.0 wt. % nickel, 1.0 wt. % carbon and, apart from incidental impurities, a balance of cobalt.

9. A composite article as defined in claim 1, wherein the metal of the first component has a melting range which commences at a temperature equal to or in excess of the liquidus temperature of the metal of the second component.

10. A composite article as defined in claim 1, wherein the metal of the first component has a melting range substantially the same as that of the metal for the second component.

* * * * *

UNITED STATES PATENT AND TRADEMARK OFFICE

CERTIFICATE OF CORRECTION

PATENT NO. : 4,953,612

DATED : September 4, 1990

INVENTOR(S) : Ian R. Sare et al.

It is certified that error appears in the above-identified patent and that said Letters Patent is hereby corrected as shown below:

column 1, line 41, for "mold" read --mild--.

column 3, line 6, for "atmosphere" read --atmospheric--.

column 3, line 9, delete "." after --distribute--.

column 3, line 26, for "124797" read --1247197--.

column 4, line 48, for "casing" read --casting--.

column 6, line 38, for "round" read --found--.

column 8, line 26, for "the" read --and--.

column 10, line 20, for "from" read --film--.

Signed and Sealed this

Twenty-third Day of February, 1993

*Attest:*

STEPHEN G. KUNIN

*Attesting Officer*

*Acting Commissioner of Patents and Trademarks*